US006513404B1

(12) United States Patent
Haringer

(10) Patent No.: US 6,513,404 B1
(45) Date of Patent: Feb. 4, 2003

(54) DEVICE FOR CONTROLLING

(75) Inventor: Alois Johann Haringer, Neumarkt (IT)

(73) Assignee: macmoter S.p.A., Modigliana (IT)

( * ) Notice: Subject to any disclaimer, the term of this patent is extended or adjusted under 35 U.S.C. 154(b) by 0 days.

(21) Appl. No.: 09/705,147

(22) Filed: Nov. 2, 2000

(30) Foreign Application Priority Data

Nov. 2, 1999 (DE) ..... 199 52 709

(51) Int. Cl.[7] ..... G05G 9/047

(52) U.S. Cl. ..... 74/471 XY; 74/531; 137/631.2; 188/267

(58) Field of Search ..... 74/471 XY, 473.23, 74/473.28, 527, 531, 491; 188/267, 267.2

(56) References Cited

U.S. PATENT DOCUMENTS 1,519,022 A * 12/1924 Deisher ..... 74/531
2,616,305 A * 11/1952 Rossire ..... 74/491
3,556,270 A * 1/1971 Comment ..... 74/531
4,023,636 A * 5/1977 Levin ..... 180/6.48
4,530,376 A * 7/1985 Chatterjea ..... 137/636.1
4,608,879 A * 9/1986 Ishida et al. ..... 74/474
5,809,841 A * 9/1998 Smith ..... 74/531
5,979,268 A * 11/1999 Freberg et al. ..... 74/531
6,098,481 A * 8/2000 Mills et al. ..... 74/471 XY

* cited by examiner

*Primary Examiner*—David A. Bucci
*Assistant Examiner*—Timothy McAnulty
(74) *Attorney, Agent, or Firm*—W. F. Fasse; W. G. Fasse

(57) ABSTRACT

A device for controlling the driving movements of a tracked vehicle includes a control lever 2 which can pivot about at least one pin 3, and a magnet arrangement by which any manually established position of the control lever 2 can be magnetically fixed. The strength of the magnetic fixing force is selected so that the control lever can be manually moved to a new position while overcoming the magnetic fixing force, and then the control lever is again magnetically held at the new position.

11 Claims, 2 Drawing Sheets

Fig.2
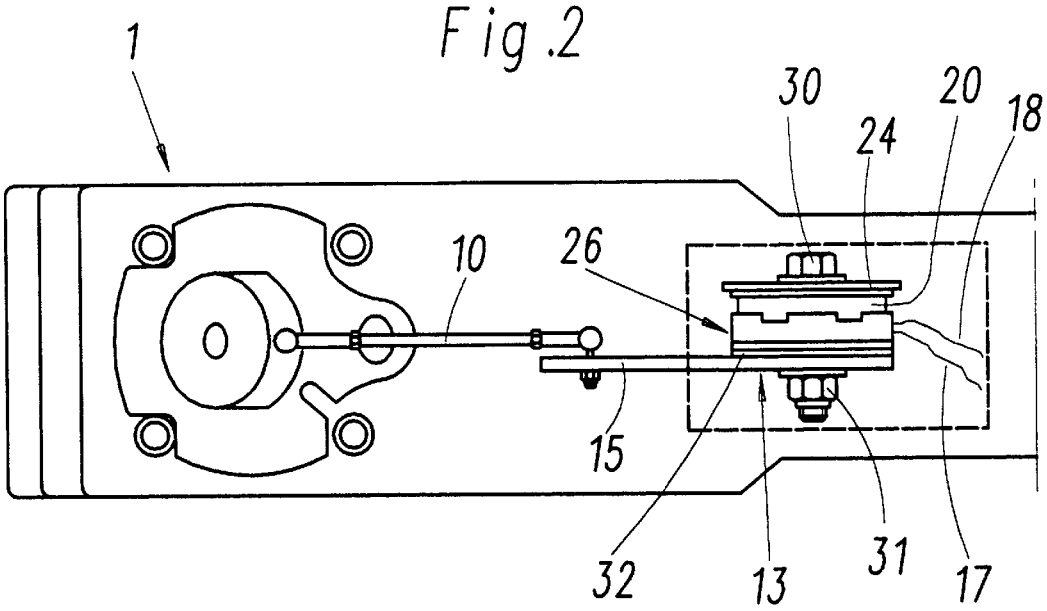
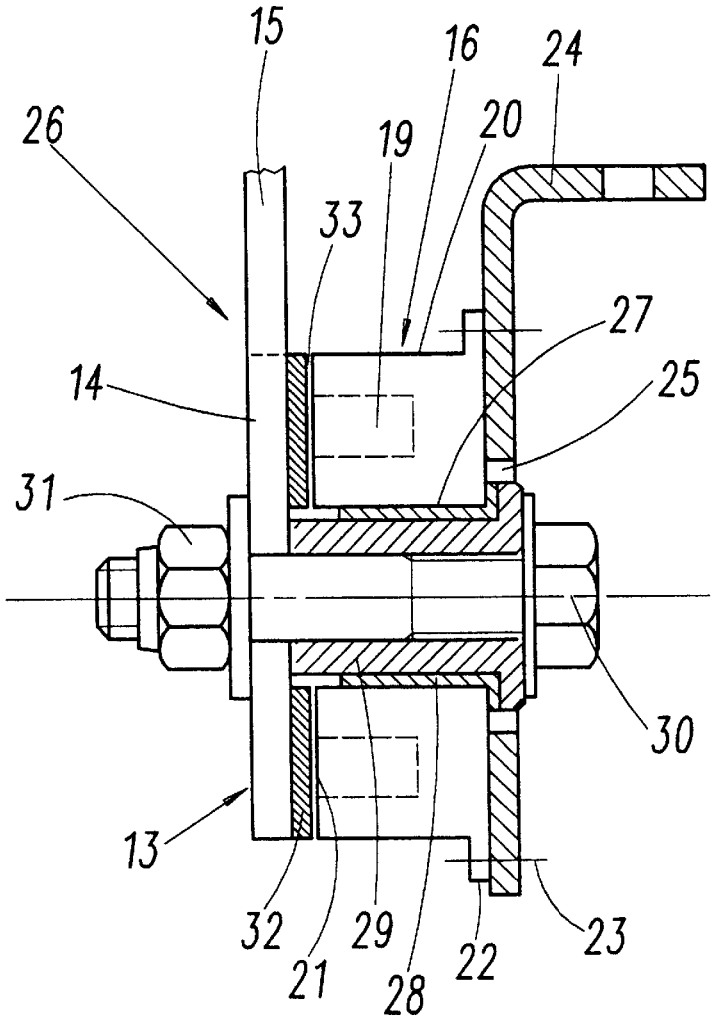
Fig.3

DEVICE FOR CONTROLLING

FIELD OF THE INVENTION

The invention relates to a device for controlling, and in particular for controlling the driving movements of a tracked vehicle, having a control lever which can pivot and/or rotate about at least one pin.

BACKGROUND INFORMATION

Control levers of the type involved here are known and can be used in tracked vehicles for the direct control of servo devices. These are in this case a servocontrol for the actual hydraulic control system, which is required, for example, for driving forwards and backwards and for contrarotation of the tracks in order to pivot the tracked vehicle. In the known devices, the driver has to continuously hold the control lever in the position into which it has been pressed. As soon as he releases the control lever, it automatically returns to its neutral, central position. This is for many applications inappropriate, so that the invention is based on the object of providing measures which are simple and inexpensive to realize and which enable the control lever to remain in a position into which it has been pressed even when the driver removes his hand from the control lever.

SUMMARY OF THE INVENTION

To achieve this object, the invention provides for the position of the control lever to be magnetically fixable. Therefore, the driver can release the control lever without the driving movements which have been set changing as a result.

Preferably, the control lever can be fixed electromagnetically and against at least one restoring force acting on it, the level of force used for fixing being such that the control lever can nevertheless be adjusted at any time by hand.

BRIEF DESCRIPTION OF THE DRAWINGS

The invention is described in more detail below with reference to an exemplary embodiment which is illustrated in the drawing and in which:

FIG. 2: shows a plan view of the device shown in FIG. 1, approximately on line II—II, and FIG. 3: shows a section through important parts of the device on a larger scale.

DETAILED DESCRIPTION OF EXAMPLE EMBODIMENTS OF THE INVENTION

Figure 1:
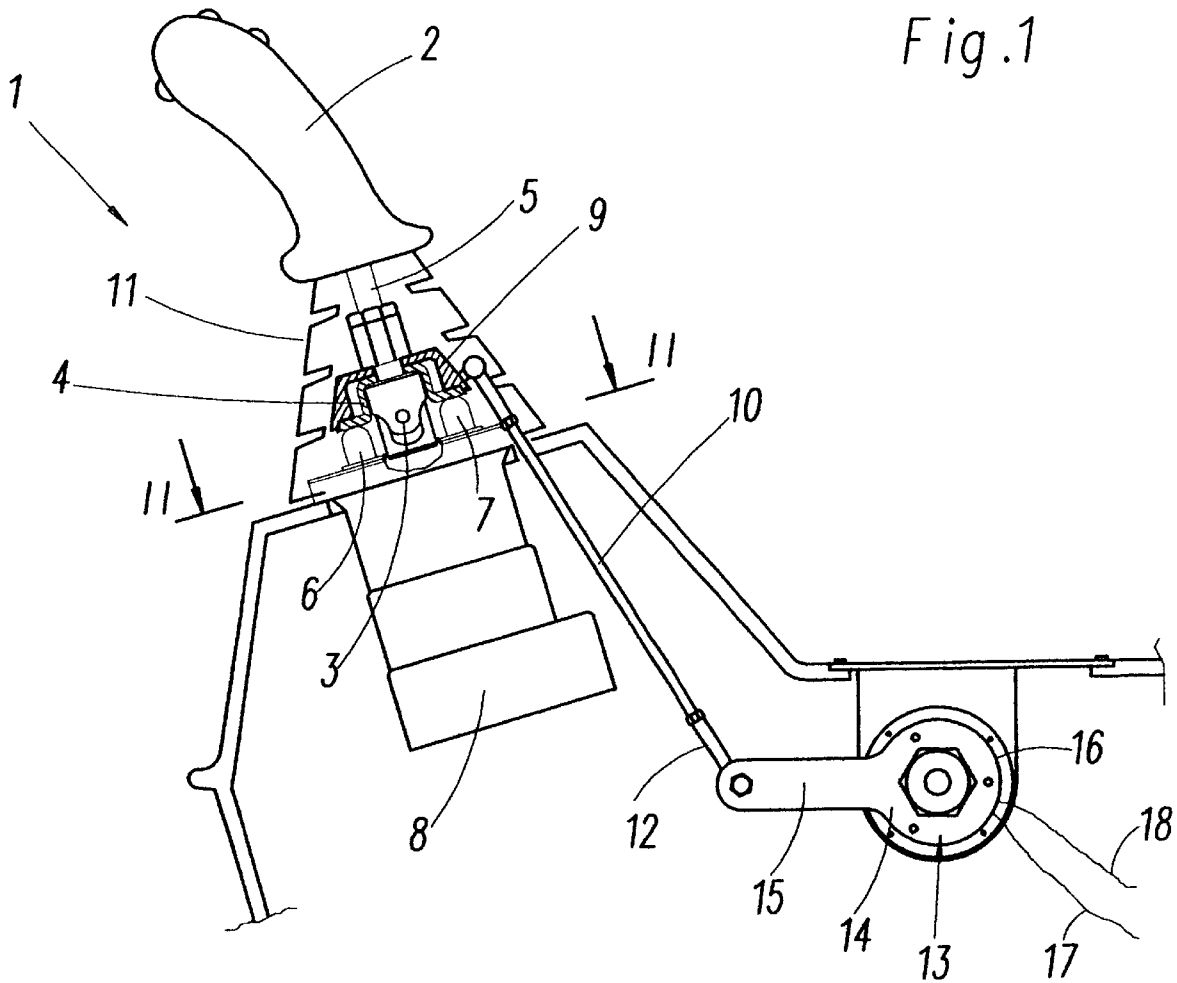
FIG. 1: shows a side view, partially in section, of the device for controlling.

In accordance with FIG. 1, a device 1 comprises a control lever 2 which is arranged so that it can pivot about a pin 3. A control bell 4 is rigidly connected to the control lever 2 via a rod 5 and transmits the movements of the control lever 2 to control pins 6 and 7 which belong to a servo device 8, which is of no further interest here, such as for example a hydraulic servocontrol device for driving forwards and backwards or for contrarotation of tracks of a tracked vehicle.

A driver 9 which is able to transmit the movements of the control lever 2 about the pin 3 to a link rod 10 is also rigidly connected to the control lever 2. In accordance with the exemplary embodiment, the driver 9 is in the form of a sleeve and engages around the control bell 4. A first end of the link arm 10 is articulatedly mounted on or connected to the driver 9, for example with the aid of a spherical head. A protective enclosure 11 engages around the parts 3, 4, 5, 6 and 7, and 9.

At its second end 12 which is remote from the driver 9, the link rod or link arm 10 is connected to a drag element 13, also called a clutch element 13 herein. The clutch element 13 comprises a ring disc 14 having an arm 15 which protrudes radially from the disc 14, and on which the second end 12 of the link arm 10 is directly articulated.

The clutch element 13 is assigned an electromagnet 16. Via electrical conductors 17 and 18, a coil or an electrical winding 19 in a housing 20 is excited so as to generate an electromagnetic field. Then, on account of this electromagnetic field, an end face 21 of the housing 20 which faces towards the clutch element 13 is also magnetic, and is non-magnetic after the current has been switched off. The housing 20 of the electromagnet 16 is attached to an angle bracket 24 by means of a flange 22 and attachment elements 23. The clutch element 13 and the electromagnet 16 are fundamental parts of a holding device 26 for the control lever 2.

In accordance with the exemplary embodiment illustrated in FIG. 3, the angle bracket 24 has a passage opening 25 through which parts of the holding device 26, which includes the electromagnet 16 and the clutch element 13, pass.

In accordance with the exemplary embodiment illustrated in FIG. 3, there is a further passage opening 27 in the housing 20, which serves to accommodate a sleeve 28 which has a flange. The sleeve 28 expediently consists of a non-magnetic material.

In the interior of the sleeve 28 there is a bearing shell 29 which serves to accommodate a shaft 30 which, in accordance with the exemplary embodiment, is a bolt. The shaft 30 or bolt engages through the ring disc 14 of the clutch element 13 and therefore rests in the bearing shell 29, and is secured against axial displacement in the housing 20 with the aid of a washer and a nut 31. Flanges on the sleeve 28 and the bearing shell 29, which engage behind the housing 20 on the side which is remote from the clutch element 13, also contribute to this securing effect.

On the housing side, the clutch element 13 also has an annular body 32 which bears against the end face 21 of the housing 20 and is fixedly connected to the clutch element 13.

In the at-rest position shown in FIG. 3, there is an air gap between the end face 21 of the housing 20 and the annular body 32. This air gap 33 may amount to 0.5 mm.

Expediently, the annular body 32 consists of the same material as that used for brake shoes of vehicles.

As soon as the control lever 2 has been pushed out of the central position illustrated in FIG. 1 into a different position, the clutch element 13 also correspondingly adopts a different position due to the movement of the control lever 2 being transmitted through the link rod 10 to the arm 15 protruding from the disc 14, whereby the arm 15 transforms the generally linear movement of the link rod 10 into a rotation motion of the disc 14 about the shaft or bolt 30.

The coil 19 or winding of the electromagnet 16 is connected to a battery and is under current. It can be switched on and off. The electromagnet 16, when it is switched on, therefore generates an electromagnetic field, which attracts the clutch element 13, which thus, by means of its annular body 32, can be fixed due to friction between the annular body 32 and the housing 20 in the position which is reached as a result of the movement of the control lever 2. The intensity of the electromagnet 16 is selected in such a manner that the control lever 2 can still be moved manually from any fixed position. Generally, the control pins 5 and 7 exert a restoring force on the control lever 2. As soon as the engine of the tracked vehicle is stopped or the current is switched off, the electromagnet 16 is also currentless once again, so that at the latest at this point the clutch element 13 and its annular body 32 are released from the end face 21 of the housing 20 so that the control lever 2 also automatically moves out of a magnetically fixed position into its neutral position by the above mentioned restoring force of the control pins 5 and 7.

The invention is not definitively limited to the exemplary embodiment illustrated in the figures, but rather it is also possible to make modifications without departing from the fundamental concept of the invention. These changes include using a plurality of electromagnets instead of a single electromagnet.

I claim:

1. A control arrangement comprising:

a manually operable control lever arranged to pivot and/or rotate about at least one first axis so that said control lever is manually movable to any selected position among plural positions;

a driver connected to said control lever so as to move with said control lever;

a magnetic holding device including a drag element, an arm protruding from said drag element, and a magnet arrangement that generates a magnetic holding force which holds said drag element relative to said magnet arrangement; and a link rod having a first end articulately connected to said driver, and having a second end articulately connected to said arm protruding from said drag element;

wherein said driver, said link rod, and said arm together couple said control lever with said drag element, so that said drag element being held by said magnetic holding force relative to said magnet arrangement further holds said control lever at said selected position through said arm, said link rod, and said driver.

2. The control arrangement according to claim 1, being a drive control arrangement for controlling the track drive of a tracked vehicle, further comprising a servo device that is connected to said control lever to receive movements of said control lever as control input commands.

3. The control arrangement according to claim 1, further comprising a biasing element that exerts a restoring force on said control lever to urge said control lever toward a particular position among said plural positions, wherein said magnetic holding force is stronger than said restoring force so that said drag element can hold said control lever at said selected position despite said biasing element exerting said restoring force on said control lever.

4. The control arrangement according to claim 1, wherein said magnetic holding force has a magnitude that can be overcome by a manual adjusting force applied to said control lever, so that said control lever can be manually moved away from said selected position, and through said driver, said link rod and said arm, said drag element can thereby be moved relative to said magnet arrangement despite said magnet arrangement exerting said magnetic holding force on said drag element.

5. The control arrangement according to claim 1, wherein said magnet arrangement comprises an electromagnet that can be selectively electrically energized to generate said magnetic holding force.

6. The control arrangement according to claim 5, wherein said electromagnet comprises a housing with an end face that faces said drag element, and an electrical winding arranged with respect to said housing so that said end face is magnetically active to exert said magnetic holding force on said drag element when said electrical winding is electrically energized.

7. The control arrangement according to claim 6, wherein said drag element comprises an annular disc.

8. The control arrangement according to claim 7, wherein said drag element further comprises an annular body of friction material arranged on said annular disc on a side thereof facing said end face of said housing.

9. The control arrangement according to claim 6, wherein said drag element is arranged with play relative to said housing so that an air gap is formed between said drag element and said end face of said housing when said electrical winding is de-energized, and so that said air gap is closed and said drag element contacts said end face of said housing when said electrical winding is electrically energized.

10. The control arrangement according to claim 6, wherein said housing has an opening therein passing through said end face of said housing, further comprising a shaft extending in said opening through said end face of said housing, and wherein said drag element is rotatably mounted to said shaft so that said drag element can rotate about said shaft relative to said housing.

11. The control arrangement according to claim 1, wherein said drag element is rotatable about a second axis, and a pivoting and/or rotating movement of said control, lever about said at least one first axis causes, through said driver, a longitudinal linear movement of said link rod, which causes, through said arm, a rotating movement of said drag element about said second axis relative to said a magnet arrangement.

* * * * *